United States Patent [19]

Tapp

[11] 4,060,360

[45] Nov. 29, 1977

[54] APPARATUS FOR DRY FORMING A LAYER OF FIBER

[75] Inventor: Frederick Tapp, Bristol, England

[73] Assignee: Karl Kroyer St. Anne's Limited, Bristol, England

[21] Appl. No.: 678,600

[22] Filed: Apr. 20, 1976

[30] Foreign Application Priority Data

May 29, 1975 United Kingdom ..... 23369/75

[51] Int. Cl.[2] ..... B29C 13/00

[52] U.S. Cl. ..... 425/83; 19/156.3

[58] Field of Search ..... 425/83; 156/3; 19/156.3, 156.4; 34/242; 68/5 E

[56] References Cited

U.S. PATENT DOCUMENTS

| | | | |
|---|---|---|---|
| 2,881,471 | 4/1959 | Snow et al. | 425/83 X |
| 3,145,430 | 8/1964 | Caron | 425/83 X |
| 3,644,078 | 2/1972 | Tachibana et al. | 425/83 |
| 3,792,943 | 2/1974 | Helgesson | 425/83 |
| 3,963,392 | 6/1976 | Goyal | 425/83 |

*Primary Examiner*—Robert L. Spicer, Jr.
*Attorney, Agent, or Firm*—Larson, Taylor and Hinds

[57] ABSTRACT

A distributor box for dry forming a layer of fiber on a forming surface spaced below it, wherein obturators, e.g. dependent flaps, are located around an air gap between the bottom of the box and the forming surface in pre-selected position to modify the lateral air flow induced into the air gap and so assist the formation of a layer with a uniform depth.

9 Claims, 10 Drawing Figures

7
15
10
17
16
17
16
21
13
13a
13
12
14
14
14

A
B
C
D
E
P
Q
R
S
20
10
10
20
+
-
BASE WEIGHT % DEVIATION

APPARATUS FOR DRY FORMING A LAYER OF FIBER

This invention relates to apparatus for dry forming a layer of fibre.

The apparatus is of the kind comprising a distributor box having an inlet for fibres and a perforated bottom wall and a movable foraminous forming surface, e.g. an endless wire belt conveyor, which is spaced below the bottom wall and arranged to receive the fibres through the bottom wall under the influence of suction exerted by a suction system which connects with the under side of the forming surface, e.g. through a suction box. A problem associated with the use of such known apparatus is the "profile" of the layer of fibre laid on the foraminous forming surface. It has been found that differing quantities of fibres are delivered by the distributor box onto the foraminous forming surface such that the thickness and weight of fibre across the foraminous forming surface will vary considerably, e.g. of the order of plus or minus 18% in a typical dry forming situation. This variation may be unacceptable.

A large number of variable factors are thought to affect the distrubition of fibre on to the forming surface, the more important being the design of the distributor box, the type, speed and direction of rotation of the rotary agitators which may be used to agitate the fibre within the box, the size of perforations in the bottom wall of the box, the vertical spacing or air gap between the bottom wall and the forming surface, the weight and form of fibre used, the degree of suction applied to the forming surface, and the linear speed of the forming surface past the distributor. By altering one or more of these variable factors it may be possible to adjust the "profile" of the fibrous layer which is laid upon the forming surface to, say, plus or minus 6% but such substantial uniformity is achieved only with difficulty.

The present invention provides an apparatus which is readily adjustable by the machine operator to produce a fibrous layer with a "profile" which is within commercially acceptable limits.

According to the present invention there is provided apparatus for dry forming a layer of fibre and comprising a distributor box having an inlet for fibres and a perforated bottom wall, a foraminous forming surface which is spaced below the bottom wall, is movable past the distributor box and is arranged to receive the fibres through the bottom wall under the influence of suction exerted by a suction system connecting with the underside of the forming surface, wherein obturating means are disposed at an air gap between the bottom wall and the forming surface, which obturating means comprise a plurality of obturators disposed at pre-selected locations to modify lateral air flow through the air gap and thereby affect the distribution of fibres upon the forming surface.

Figure 2:
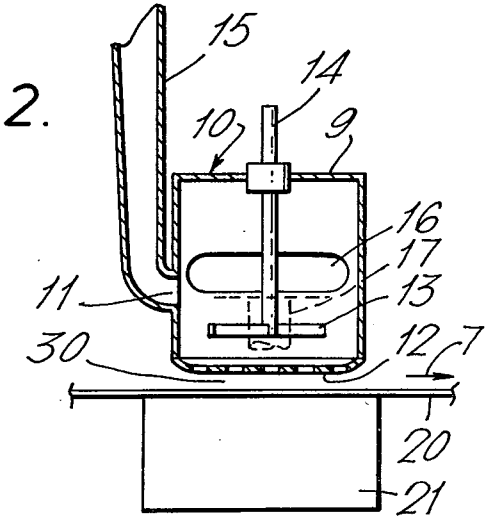
Figure 1:
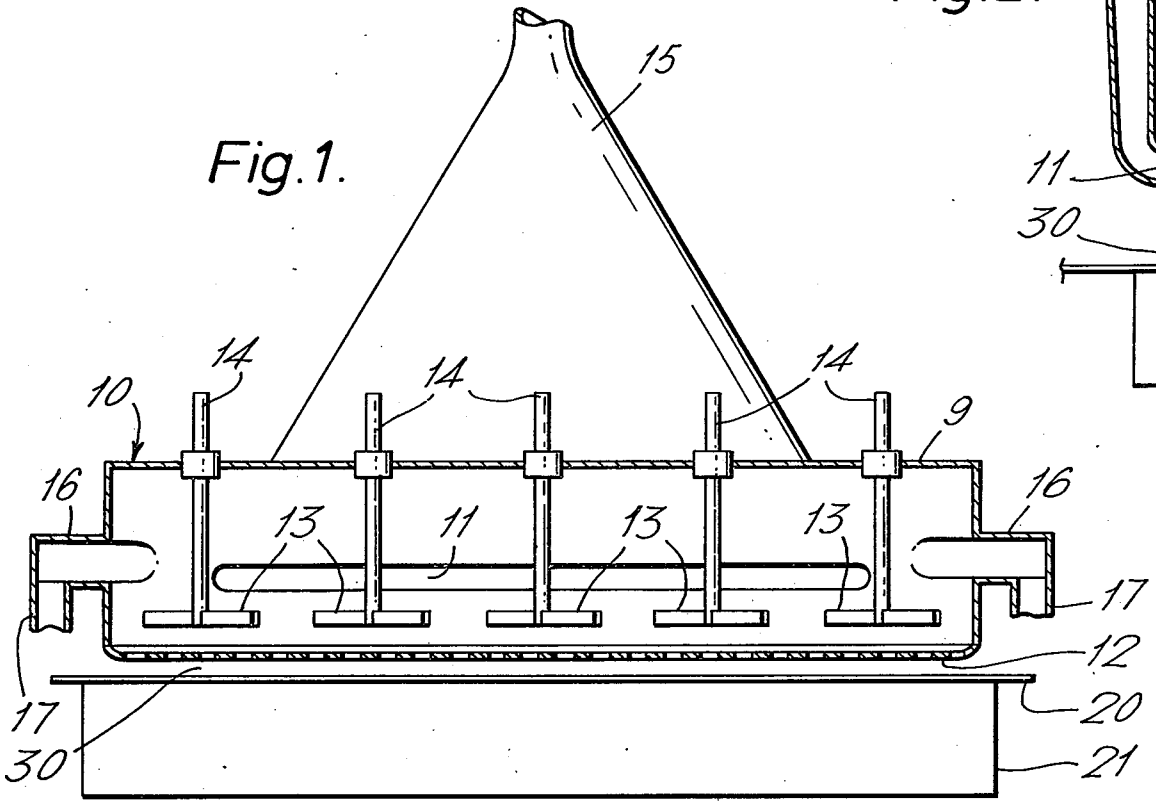
Figure 3:
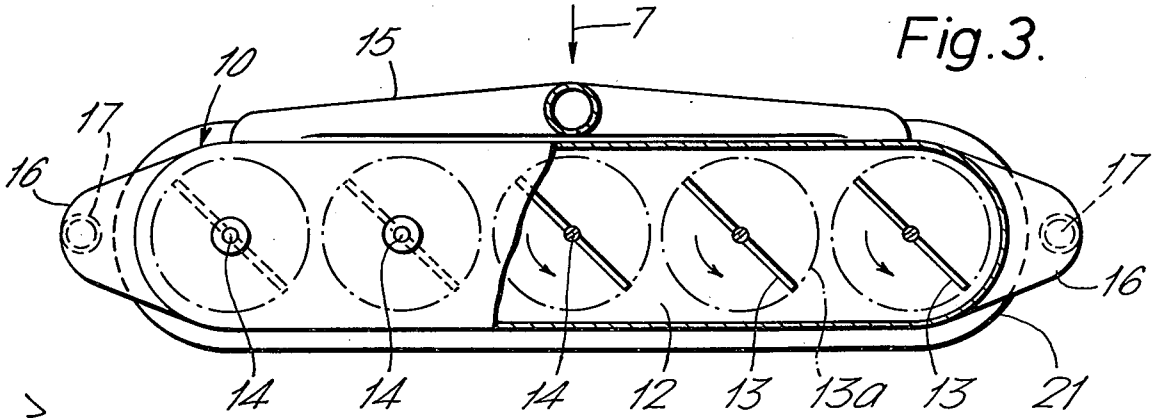
Figure 4:
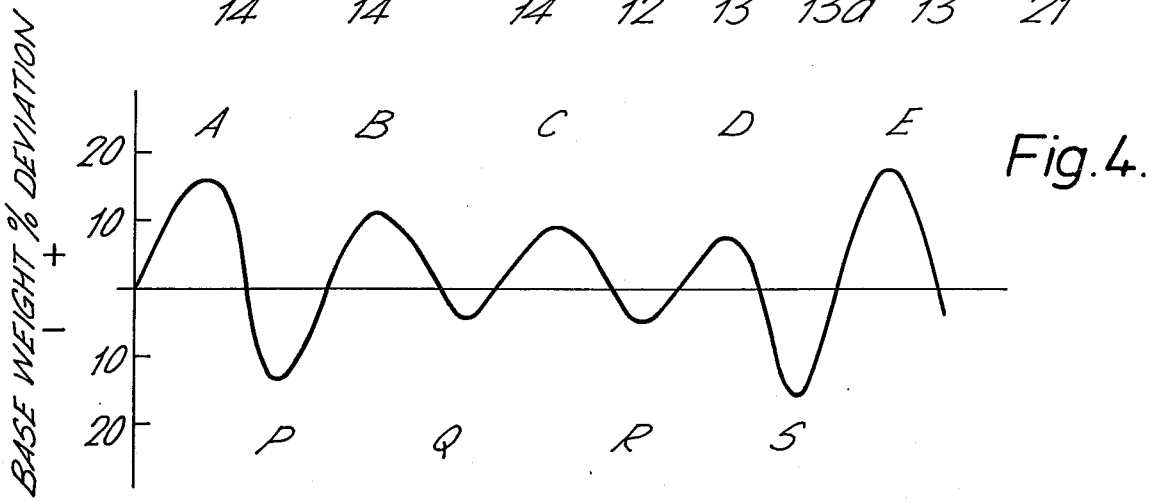
Figure 6:
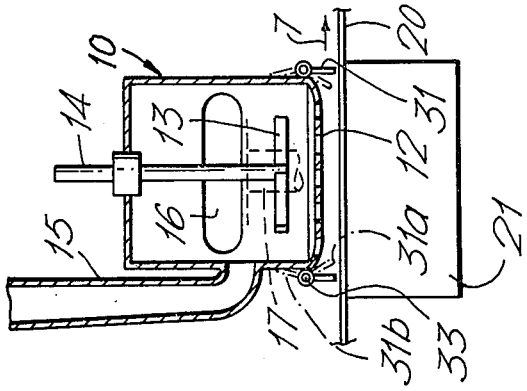
Figure 5:
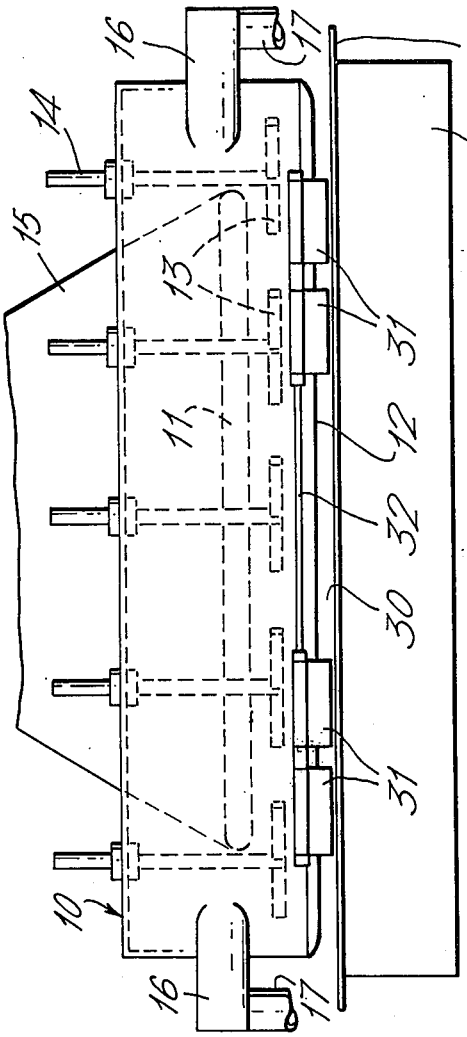
Figure 7:
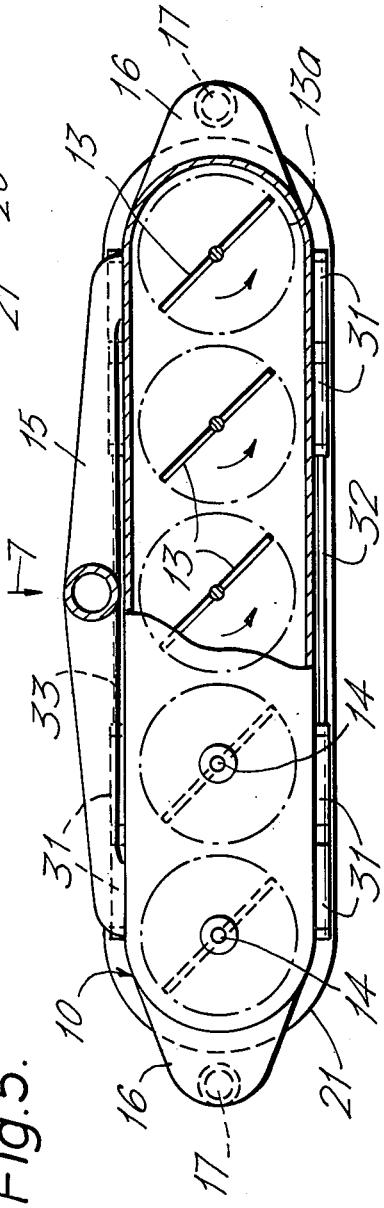
Figure 8:
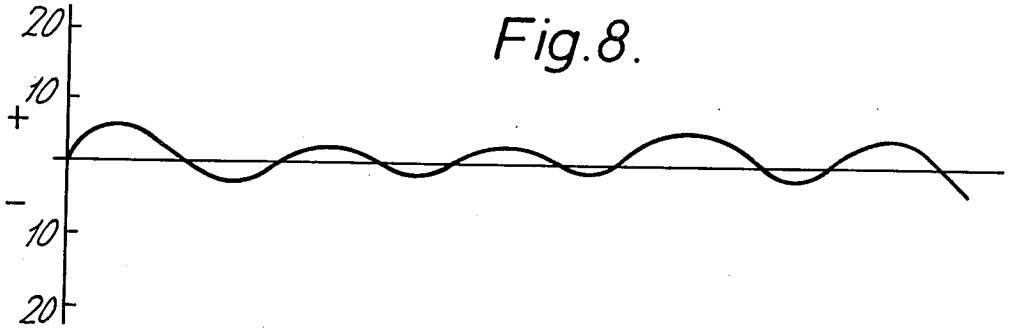
Figure 10:
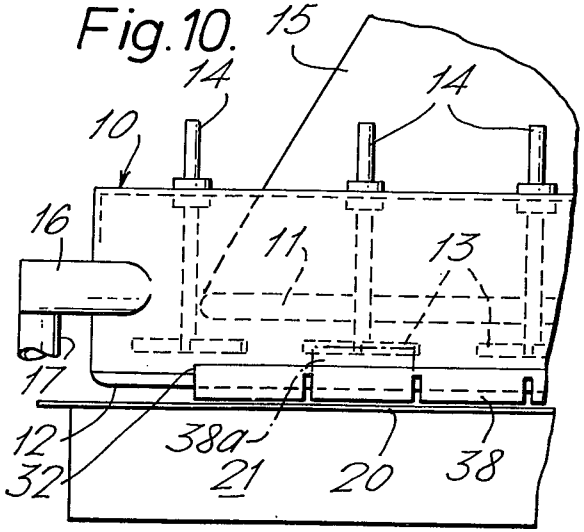

The invention is illustrated by way of example in the accompanying diagrammatic drawings of which, FIG. 1 is a vertical section through a known distributor box, FIGS. 2 and 3 are respectively a vertical cross-section and horizontal section through the box of FIG. 1, FIG. 4 is a graph showing a typical basis weight "profile" of a fibrous layer produced by three boxes arranged in series, each box being of the kind shown in FIGS. 1-3, FIG. 5 is a vertical section through a distributor box provided with obturator flaps according to the present invention, FIGS. 6 and 7 are respectively a vertical cross-section and horizontal section through the box of FIG. 5, FIG. 8 is a graph showing a basis weight "profile" of a fibrous layer produced by three boxes arranged in series, each box being of the kind shown in FIGS. 5-7, FIG. 9 is a vertical cross-section through a distributor box provided with obturator rollers according to the present invention, and FIG. 10 is a vertical section through a distributor box provided with obturator interrupted skirts according to the present invention.

Referring to the drawings there is shown in FIGS. 1 to 3 a distributor box or housing similar to that described in copending U.S. Patent Application Ser. No. 640,219 filed Dec. 12, 1975 and comprising an elongate box 10, having a fibre inlet 11, a perforated top wall 9 and a perforated flat bottom wall 12 which may be a wire mesh screen. Within the box 10 are disposed a plurality of rotors 13 mounted on the lower ends of a plurality of vertical shafts 14 each rotor being arranged to sweep a circular path 13*a*. Raw fibrous material is fed by a stream of carrier air to the box 10 through a divergent feed pipe 15 which connects with the inlet 11.

An outlet 16 is provided at opposing ends of the box for conducting away fibres which are in excess of the requirements of the distributor box via a pipe 17 to be returned to the source of fibrous material source which feeds the duct 15.

Spaced below the bottom wall 12 is a foraminous forming surface 20 in the form of an endless wire belt conveyor below which is a suction box 21 forming part of a suction system, the suction box connecting with the underside of the forming surface 20. The vertical spacing or gap between the bottom wall 12 and the forming surface 20 is given the reference numeral 30. The direction of travel of the forming surface 20 is given by arrow 7.

In operation of the known distributor box, fibres supplied through the divergent duct 15 enter the box 10 through the inlet 11 and settle on the perforated bottom wall 12. The fibres are distributed across the bottom wall 12 by the rotors 13 and pass through the perforated bottom wall 12 under the influence of suction applied via the suction box 21 which draws the fibres onto the forming surface 20. Excess fibres are drawn out of the box 10 via the pipes 17.

FIG. 4 illustrates the basis weight "profile" across the fibrous layer obtained by measuring the total weight of fibres laid from three distributor boxes. The fibrous layer after deposition by the third box weights 110 grams per square meter. FIG. 4 does not indicate the amount of fibre deposited upon the forming surface 20 but the deviation in the weight of fibre from a design figure. It will be seen that the deviation is plus or minus 15%. The crests A to E of the "profile" relate to the centres of the rotors 13 (FIG. 3) whereas the troughs P to S relate to the unswept areas between the radial arms of adjacent rotors 13.

The air flows with the gap 30 indicate that the volume of induced air flowing into the gap varies around the periphery of the gap. It is thought that this variation is brought about by a number of variable factors including the shape and form of the box 10, the linear speed of the surface 20, the way that the fibres are being distributed, the degree of suction applied by the box 21, the peripheral speed and direction of rotation of the rotors 13, the amount of fibres contained within the distributor box 10, and the amount of carrier air used to carry the fibres into the distributor box. Other variable factors are also thought to be relevant but the ones listed above appear to be those most influential in affecting the air flows in the gap 30.

Experience to date has not indicated a precise relationship between these variable factors, the amount of air being drawn into the gap 30, and the pattern of the air flow around the box 10. However, by experiment and measurement of the air flow it can be determined where air is flowing into the gap 30 to such a degree that it is having an undue affect on the amount of fibre being deposited on the surface 20, resulting in crests and troughs in the fibrous layer formed on the surface 20.

To overcome this problem and obtain a more uniform "profile", the apparatus shown in FIGS. 5 to 7 is now proposed according to the present invention.

Referring to FIGS. 5 to 7, the distributor box 10 is similar to the corresponding box of FIGS. 1–3 but is modified by the provision of obturators disposed at the air gap 30 between the bottom wall 12 and the forming surface 20. The obturators take the form of dependent flaps 31, of which one series of flaps are pivotally supported on a horizontal rod 32 mounted from the downstream peripheral portion or side of the box 10 whilst another series of four flaps 31 are pivotally supported on a horizontal rod 33 mounted from the upstream peripheral portion or side of the box 10. The gap 30 is, in this embodiment, about 4 inches high, the flaps 31 depending downward to within half an inch of the forming surface 20, but not touching it.

The flaps 31 are free to swing upon the rods 32, 33 so that in use they vibrate due to the air flows about them which prevents the build-up of fibre upon these flaps. Before operation the flaps 31 hang down vertically as shown in full line in FIG. 6 but during operation they pivot inwards as shown in dotted line 31*a*, the inward movement of the flaps being caused by the induced flow of ambient air from around the box 10 into the gap 30.

When not required, the flaps 31 are pivoted upwards to an inoperative position 31*b*.

The flaps 31 are freely movable along their respective rods 32, 33 and so are selectively disposable along the box 10, i.e. across the surface 20, relative to the position of the rotors 13. It has not been found in practice that the flaps 31 need to be located at particular points with respect to the rotors 13 but they are positioned by trial and error according to the observation or sensing of air flows within the gap 30 by the machine operator.

By the use of such flaps 31 on three distributor boxes 10 arranged in series the basis weight "profile" of the fibrous layer delivered by the improved distributor boxes is substantially uniform. As seen from FIG. 8 the "profile" deviation is of the order of plus or minus 4% with correspondingly reduced crests and troughs.

The flaps 31 are of aluminium but may be of other suitable material e.g. rubber or cloth.

Figure 9:
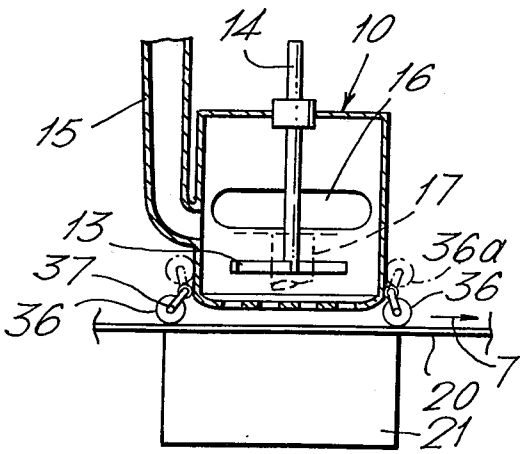

The modification of the air flows into the gap 30 can be achieved by other forms of obturator in or adjacent the gap. Thus as shown in FIG. 9 the obturators may be provided by cylindrical rotatable members or rollers 36, a separate roller replacing each flap. In such an arrangement the rollers 36 are mounted on two shafts 37 which replace the rods 32, 33, the rollers being selectively disposed along their shafts and fixed in position by for example grub screws. The rollers obturate the gap 30 at the selected positions and thus affect the lateral air flow into the gap. As with the flaps 31 the rollers extend just short of the surface 20. The roller shafts are horizontal and disposed between the bottom wall 12 and the surface 20. The roller shafts 37 can be driven either separately or through a common drive so that the resulting rotation of the rollers acts to deter a possible build-up of fibres on the surfaces of the rollers. When not required a roller can be swung upwards to an inoperative position 36*a*.

Alternatively, as shown in FIG. 10, the obturators may be provided by straight skirts 38 of flexible material cut or otherwise interrupted at selected locations. When not required, the relevant section of a skirt can be swung upwards about its supporting rod 32 or 33 to an inoperative, position e.g. position 38*a*.

The "profile" of the fibrous layer laid by the improved distributor boxes may be further improved by alteration of one or more of the variable factors referred to previously. For example, the type of agitator in the box 10 may be changed and/or the suction applied through the box 21 may be modified.

I claim:

1. Apparatus for drying forming a layer of fibre and comprising a distributor box having an inlet for fibres and a fixed perforated bottom wall, a foraminous forming surface which is spaced below the bottom wall, is movable past the distributor box and is arranged to receive the fibers through the bottom wall under the influence of suction exerted by a suction system connecting with the underside of the forming surface, wherein obturating means are disposed at an air gap between the bottom wall and the forming surface, which obturating means comprise a plurality of obturators positioned along the periphery of the air gap which are adjustable to provide variation in positions wherein laterally inward air flow through the periphery of the air gap is obstructed and positions wherein air openings are provided for laterally inward air flow through the periphery of the air gap.

2. Apparatus according to claim 1, wherein the obturators are selectively disposable along the periphery of the bottom of the distributor box.

3. Apparatus according to claim 1, wherein the obturators are selectively disposable along the upstream and downstream peripheral portions of the bottom of the distributor box.

4. Apparatus according to claim 1, wherein the obturators are flaps.

5. Apparatus according to claim 4, wherein the flaps depend from pivot supports and are free to vibrate.

6. Apparatus according to claim 4, wherein series of dependant flaps are pivotally supported on common rods mounted from upstream and downstream peripheral portions of the distributor box.

7. Apparatus according to claim 4, wherein the flaps are dependant from pivot supports and are individually pivotable upwardly to an inoperative position when not required.

8. Apparatus according to claim 1, wherein the obturators are provided by at least one skirt of flexible material which is interrupted at selected locations.

9. Apparatus according to claim 1, wherein the obturators are separate rotatable rollers mounted on horizontal shafts.

* * * * *